United States Patent [19]

DiMarco et al.

[11] 4,233,482

[45] Nov. 11, 1980

[54] ENCLOSED FUSED DISCONNECT SWITCH

[75] Inventors: Bernard DiMarco; Ralph C. Clement; Charles W. Parmenter, all of Bellefontaine, Ohio

[73] Assignee: Gould Inc., Rolling Meadows, Ill.

[21] Appl. No.: 772,441

[22] Filed: Feb. 28, 1977

[51] Int. Cl.[3] ..... H01H 1/42

[52] U.S. Cl. ..... 200/163; 200/16 D; 200/255; 200/260; 200/335; 337/10

[58] Field of Search ..... 200/5 R, 16 R, 16 D, 200/16 E, 168, 50 C, 67 A, 163, 254, 255, 260, 275, 279, 282, 330, 331, 332, 335, 304, 337, 76, 159 A, 161; 337/8–11

[56] References Cited

U.S. PATENT DOCUMENTS

| | | | |
|---|---|---|---|
| 1,463,908 | 8/1923 | Platt | 200/304 |
| 1,837,163 | 12/1931 | Kearns | 200/254 |
| 1,910,205 | 5/1933 | Frank | 200/335 |
| 1,947,277 | 2/1934 | Sachs | 200/282 X |
| 2,019,416 | 10/1935 | Johansson | 337/10 |
| 2,188,780 | 1/1940 | Sambleson et al. | 200/76 |
| 2,210,501 | 8/1940 | Sachs | 200/76 X |
| 2,521,561 | 9/1950 | Batcheller | 200/163 X |
| 2,738,399 | 3/1956 | Hammerly | 337/8 X |
| 2,995,043 | 8/1961 | Lusic et al. | 200/76 |
| 3,320,380 | 5/1967 | Groves et al. | 200/76 |
| 3,350,522 | 10/1967 | Olson | 200/76 |
| 3,422,238 | 1/1969 | Rys et al. | 200/337 |
| 3,818,169 | 6/1974 | Kobernus | 200/159 A |
| 3,856,177 | 12/1974 | Fudge | 220/82 R |
| 3,931,488 | 1/1976 | Beyer | 200/161 |
| 4,110,584 | 8/1978 | Erickson et al. | 200/304 |

FOREIGN PATENT DOCUMENTS

| | | | |
|---|---|---|---|
| 512712 | 9/1939 | United Kingdom | 200/335 |

*Primary Examiner*—Stephen Marcus

*Attorney, Agent, or Firm*—Ostrolenk, Faber, Gerb & Soffen

[57] ABSTRACT

An enclosed multipole fuse disconnect switch is constructed of a single molded base, a single contact carrier, and an overcenter spring powered toggle mechanism constructed solely of a coiled compression spring and a stamped sheet metal tongue which extends through an aperture in the contact carrier. The tongue is formed integrally with a pivot shaft through which operating forces are applied to the toggle mechanism. Each pole includes a U-shaped bridging contact constructed of spring metal and floatingly mounted in an aperture of the contact carrier.

One end of the pivot shaft extends into a slot in the enlarged end of a bearing rivet that extends through the sidewall of the switch enclosure and is keyed to a manual operating member at one end thereof. The latter extends through a guide slot in an arcuate bracket outside the enclosure. With the operating member in switch open position, an aperture in the member is aligned with an aperture in the bracket to receive a padlock for maintaining the operating member in switch open position.

15 Claims, 17 Drawing Figures

OFF

ENCLOSED FUSED DISCONNECT SWITCH

For the most part, fused or unfused enclosed disconnect switches of relatively low power ratings are provided with movable contacts that are hinged and the operating mechanisms are mounted in the enclosure at a location remote from the base that mounts the contacts. These constructions appear to be overly costly in relation to the functions achieved.

To overcome these disadvantages of the prior art the instant invention provides an enclosed switch construction in which the switch unit includes both the contacts and an overcenter toggle contact operating mechanism. The number of individual parts is minimized and assembly is simplified by utilizing a bridging contact construction in which, for each pole, the movable contact is a U-shaped spring member which is floatingly mounted in a contact carrier common to all poles. The carrier is reciprocated in the guidways of a molded base which is provided with bearing formations for an operating lever stamped of sheet metal and having an integral tongue which constitutes one arm of an overcenter toggle mechanism. The other arm of the toggle mechanism is constituted solely by a coiled compression spring, one end of which bears against a base formation and the other end of which engages the free end of the tongue. The operative connection between toggle mechanism and the contact carrier is obtained by extending the tongue through an aperture in the contact carrier.

The operating lever is provided with a shaft portion, generally at right angles to the tongue, which is seated on shaft portion bearing formation of the base, and one end of the shaft portion extends into a slot in the enlarged head of a shoulder rivet. The shank portion of this rivet extends through a bearing aperture in the side of the enclosure and is connected outside the enclosure to a manual operating member. The latter extends through a guide slot in a bracket external to the enclosure. With the operating member in a switch open position aligned apertures in the operating member and bracket are adapted to receive the shackle of a padlock for the purpose of locking the switch apparatus in open circuit position.

Accordingly, a primary object of the instant invention is to provide a novel disconnect switch mounted within an enclosure and operable by a handle outside of the enclosure.

Another object is to provide a disconnect switch of this type constructed of a minimal number of moving parts.

Still another object is to provide a disconnect switch of this type constructed so that the cost of parts and assembly thereof is relatively low.

A further object is to provide a disconnect switch of this type and simplified means connecting the switch to an operating handle outside of an enclosure wherein the switch is mounted.

A still further object is to provide a disconnect switch of this type having movable bridging contacts which are mounted to a common contact carrier in a floating manner.

These objects, as well as other objects of this invention, shall become readily apparent after reading the following description of the accompanying drawings, in which:

FIG. 1 is a front elevation of switch apparatus embodying the instant invention, with the enclosure cover shown in open position.

FIGS. 2 and 3 are side and end elevations of the switch apparatus looking in the directions of the respective arrows 2—2 and 3—3 of FIG. 1, with the cover closed.

FIG. 4 is an enlarged cross-section taken through line 4—4 of FIG. 1 looking in the direction of arrows 4—4.

FIGS. 5 and 6 are side elevations of the switch unit looking in the directions of respective arrows 5—5 and 6—6 of FIG. 1.

Figures 3, 4, 11, 12, 13, 14, 15:
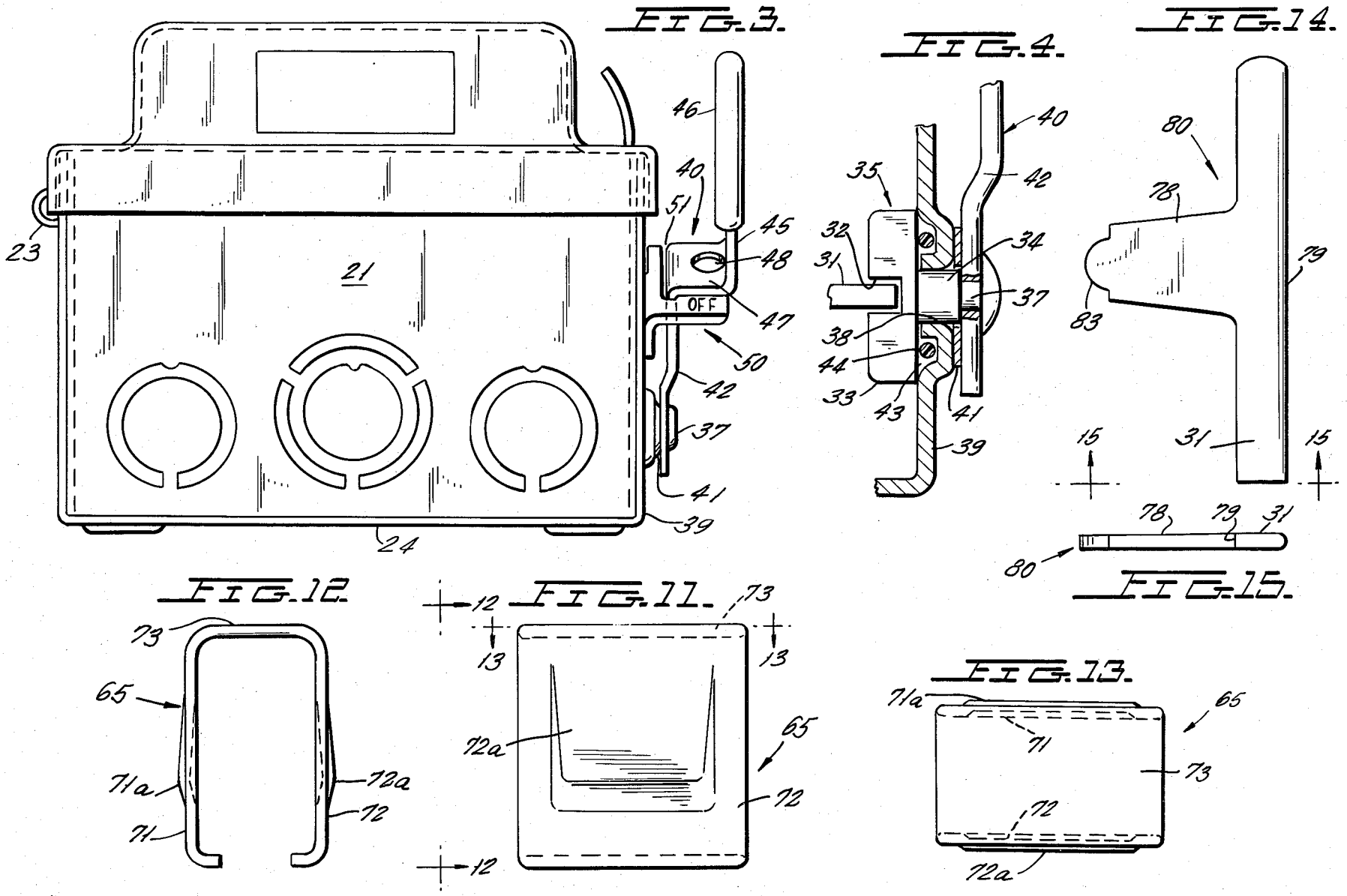
FIG. 11 is an end elevation of one of the movable contacts.
Figure 6:
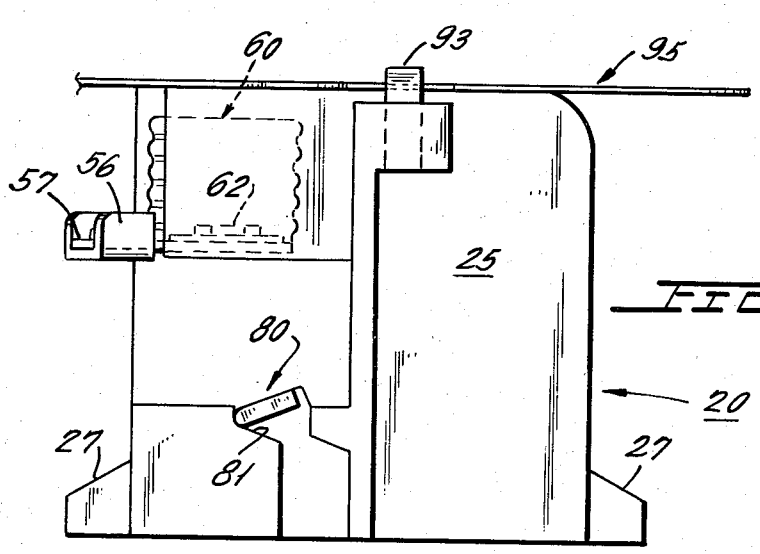

FIGS. 12 and 13 are elevations of the movable contact looking in the directions of respective arrows 12—12 and 13—13 of FIG. 11.

FIG. 14 is a plan view of the operating lever.

FIG. 15 is a side elevation of the operating lever looking in the direction of arrows 15—15 of FIG. 14.

Figure 7:
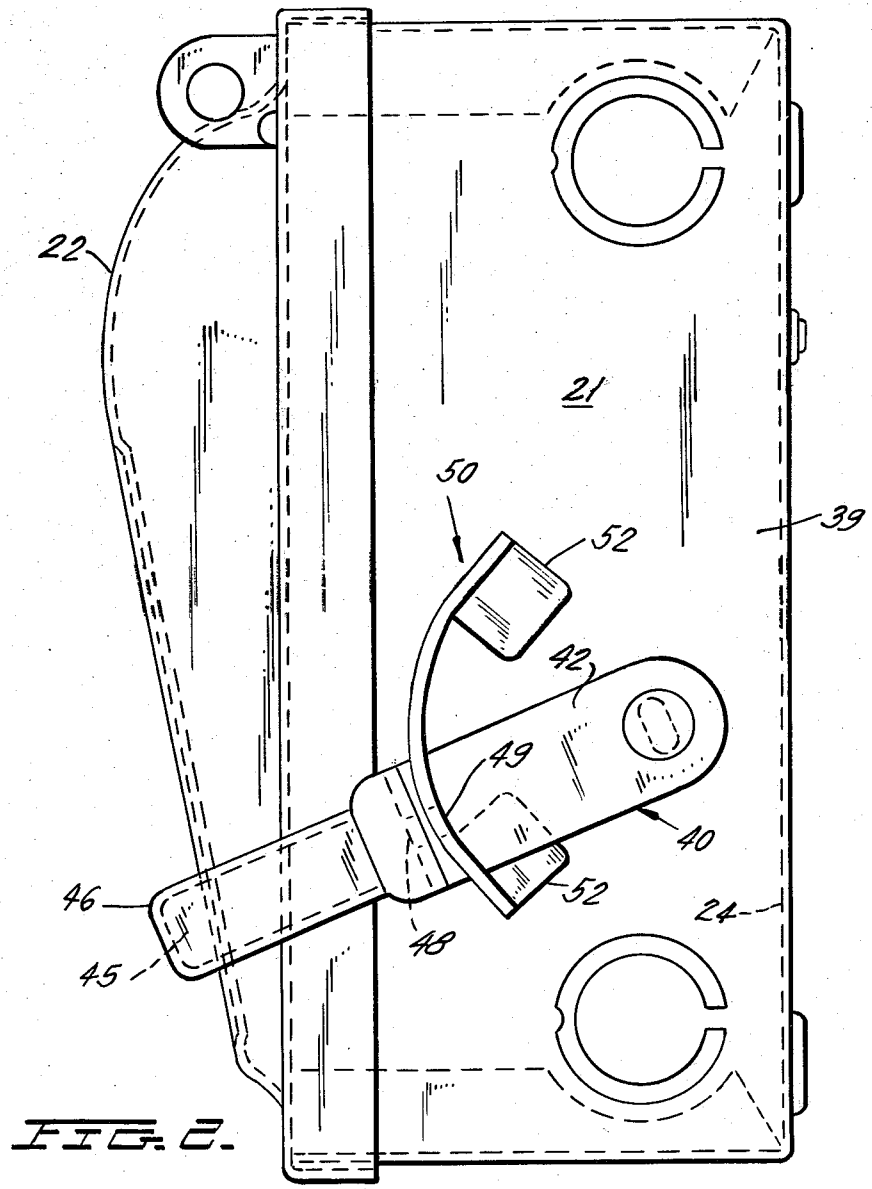
FIG. 7 is a rear elevation of the switch unit looking in the direction of arrows 7—7 of FIG. 5.
Figure 16:
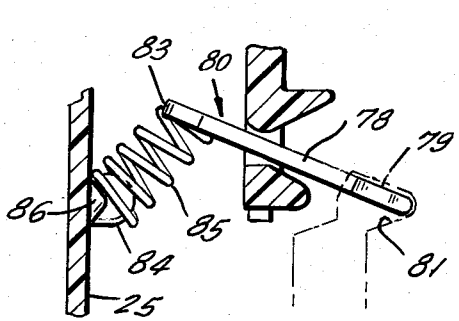
Figure 17:
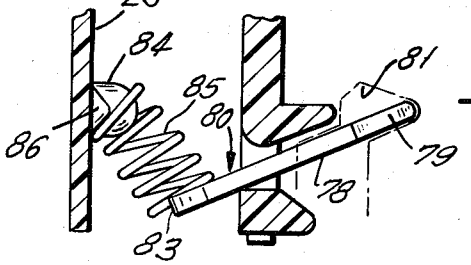
Figure 7:
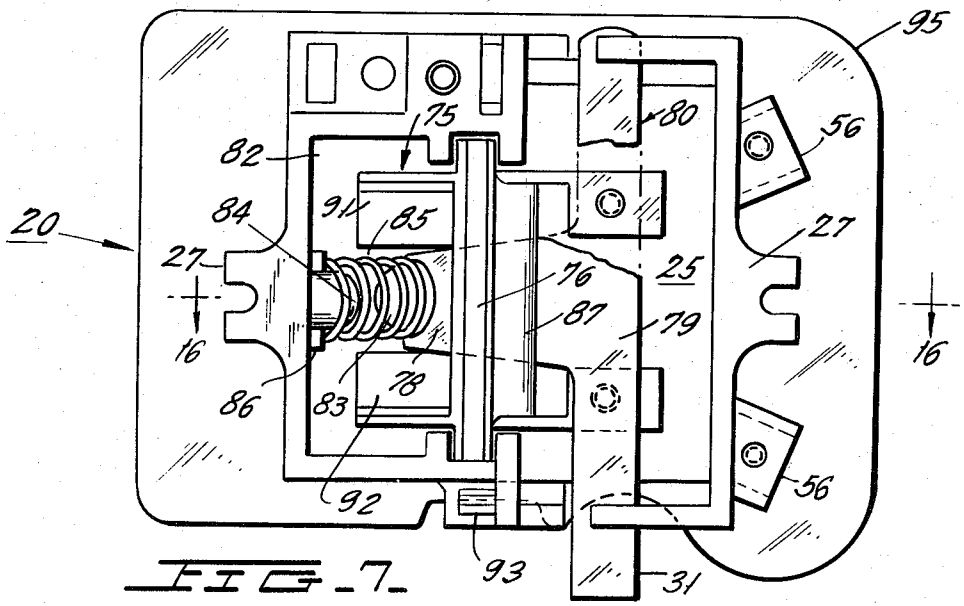

FIGS. 16 and 17 are fragmentary elevations taken through line 16—16 of FIG. 7 looking in the direction of arrows 16—16 and illustrating the toggle mechanism elements in the contact open and closed positions, respectively.

Figure 1:
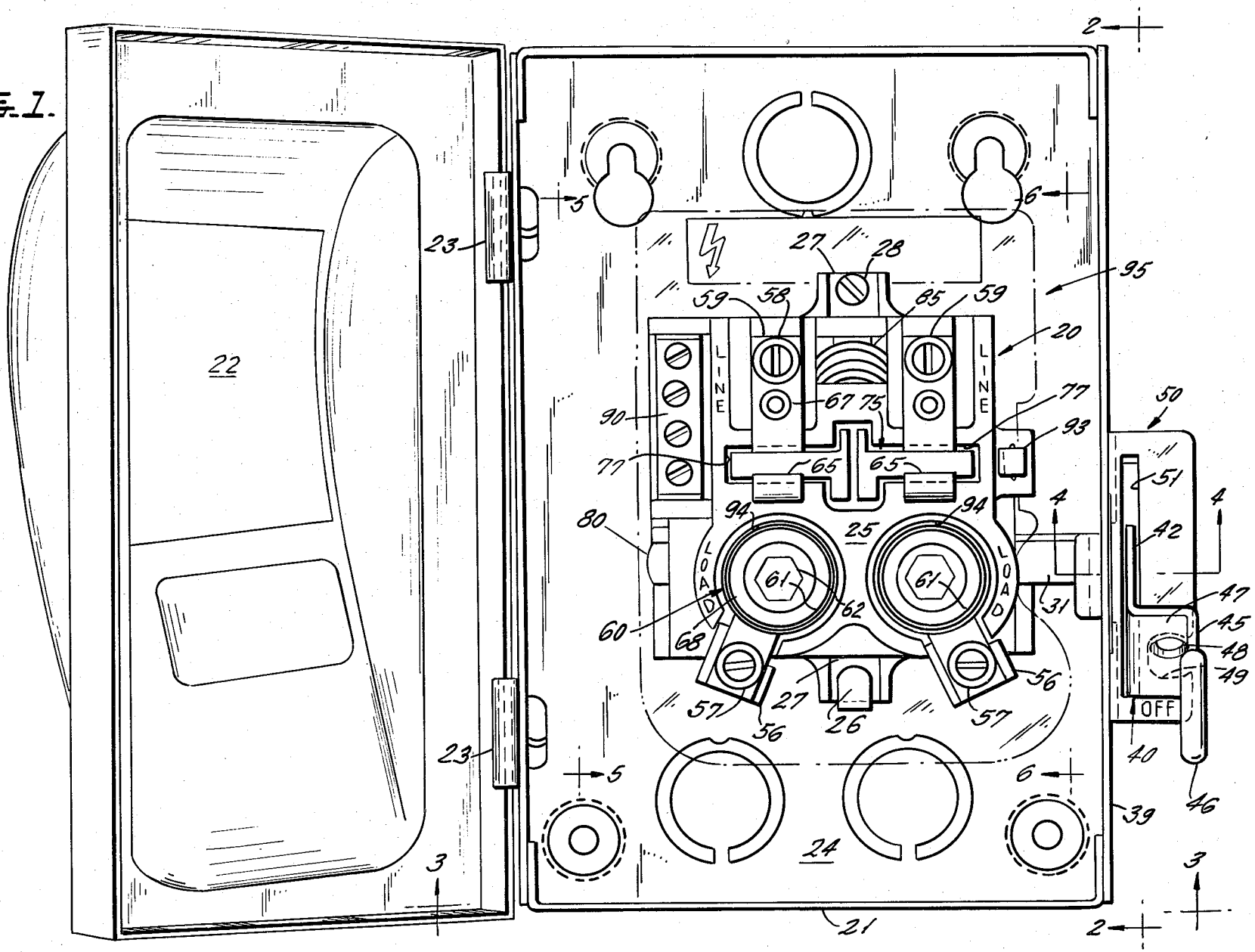

Now referring to the Figures. In FIG. 1 fused disconnect switch 20 is shown mounted within metal enclosure 21 having openable front cover 22 mounted on hinges 23, 23 along one side of enclosure 21. Forwardly offset hook 26 formed integrally with rear wall 24 of enclosure 21, and screw 28 engaged in a threaded aperture in rear wall 24 cooperate with ears 27, 27 projecting from opposite ends of molded base 25 at the rear thereof to operatively secure fused disconnect switch 20 on the forward surface of rear wall 24. As will hereinafter be seen, manual operating forces are transmitted to switch 20 through extension 31 projecting from one side of base 25 into diametric slot 32 in enlarged head 33 of shoulder rivet 35. Rivet 35 also includes shank 34, of round cross-section, having head 33 at one end thereof and tang 37, of rectangular cross-section, at the other end thereof (FIG. 4). Shank 34 extends through bearing aperture 38 in sidewall 39 of enclosure 21 and through flat washer 41 interposed between sidewall 39 and the rear or drive end 42 of operating member 40. Tang 37 extends through a complementary aperture in drive end 42, and the free end of tang 37 is peened over to secure operating member 40 to shoulder rivet 35. Sidewall 39, in the region surrounding aperture 38, is formed to provide annular recess 43 concentric with aperture 38 and confronting head 33. O-ring 44 and a grease-like substance (not shown) are disposed within recess 43.

Drive end 42 of operating member 40 extends forward from tang 37 through guide slot 51 in arcuate bracket 50 projecting sideways from wall 39, being welded thereto at bracket ears 52, 52. The forward or free end 45 of member 40 covered by plastic cap 46, is offset with respect to drive end 42 in a direction away from sidewall 39. Drive end 42 and free end 45 of member 40 are joined by connecting portion 47 disposed generally at right angles to ends 42, 45 and positioned immediately forward of bracket 50. Connecting portion 47 is provided with aperture 48 which, in the switch off position shown in FIGS. 1–3, is aligned with notch 49, extending from the free edge of bracket 50 partway toward guide slot 51. Aperture 48 and slot 49 are proportioned to receive the shackle of a padlock (not shown) to lock operating member 40 in the switch off position.

Fused switch unit 20 is a two-pole device having essentially identical current carrying elements for each pole. For each pole, the current carrying path between terminal screw 56 on load terminal member 57 and terminal screw 58 on line terminal member 59 consists of load terminal 57 abutting the floor inside shell 61 of screw type fuse receptacle 60, the fuse (not shown) in receptacle 60, the head of screw 62 constituting the other terminal for receptacle 60, the body of screw 62 to conducting strap 63, forwardly extending jaw section 64 of strap 63, movable bridging contact 65, rearwardly extending jaw section 66 of line terminal strap 59, to terminal screw 58.

Rivet 67 secures line terminal strap 59 to base 25 and the threaded engagement between screw 62 and load terminal strap 63 secures the latter to base 25. Insulating disk 68 within shell 61 insulates the latter from screw 62.

Figure 10:
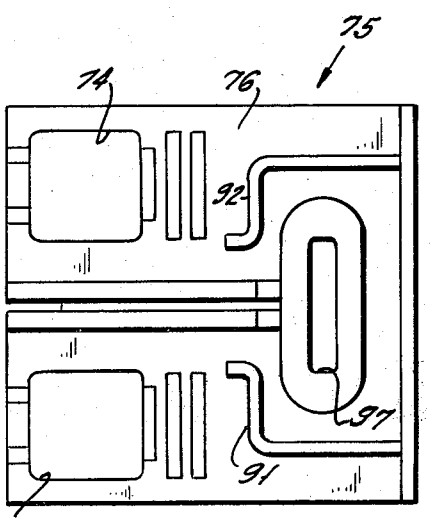
FIG. 10 is an end elevation of the contact carrier looking in the direction of arrows 10—10 of FIG. 9.
Figure 9:
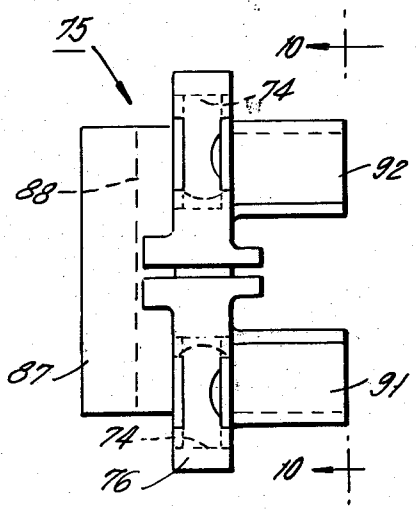
FIG. 9 is a front elevation of the contact carrier looking in the direction of arrows 9—9 of FIG. 8.
Figure 8:
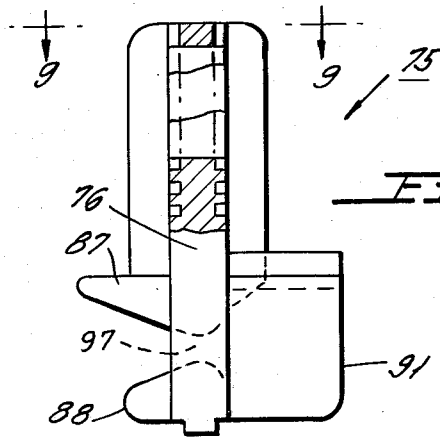
FIG. 8 is a side elevation of the contact carrier looking in the direction of arrows 6—6 of FIG. 1.

As seen best in FIGS. 11 through 13, bridging contact 65 is of U-shaped cross-section having arms 71, 72 extending rearward from web 73. Bridging contacts 65 for both poles are mounted within rectangular windows 74, 74 of molded contact carrier 75 (FIGS. 8–10). The latter includes generally planar main section 76 whose side edges are disposed within guideways 77, 77 of base 25 so that carrier 75 is movable forward and rearward while section 76 is in a plane at right angles to rear wall 24 of enclosure 21. Bridging contact 65 is constructed of conducting spring material so that the free ends of arms 71, 72 and their respective offset contact surfaces 71*a*, 72*a* are normally biased outwardly toward engagement with the stationary contact jaws 64, 66 when carrier 75 is in its rearward position. Guideways 77, 77 partially overlap movable contact 65 to retain the latter within carrier windows 74.

Near the rear thereof, main section 76 of carrier 75 is provided with elongated aperture 97 through which tongue 78 of operating lever 80 extends. The latter is a sheet metal stamping which also includes shaft section 79 having the extension 31 at one end thereof. Tongue 78 is at right angles to shaft section 79 and is disposed near the center thereof. Shaft 79 is disposed within V-shaped bearing notches 81 in opposite sides of base 25. Notches 81 communicate with base cavity 82 which is open at the rear of base 25 and has tongue 78 disposed therein. The free end of tongue terminates in semicircular tip 83 providing a seat for one end of coiled compression spring 85 whose other end surrounds spherical formation 84 in base cavity 82. Formation 84 is integral with base 25 and projects from embossment 86 of triangular cross-section.

Spring 85 and tongue 78 form the links of an overcenter toggle for moving contact carrier 75 with a snap action. That is, by pivoting shaft section 79 of operating lever 80 counterclockwise from the switch open position of FIG. 16 to the switched closed position of FIG. 17, toggle knee 83 is moved rearward until it is overcenter or to the rear of a line extending between the fixed pivot for lever 80 and the end of spring 85 remote from knee 83. Now the force of spring 85 is directed rearward thereby moving contact carrier 75 rearward with a snap action so that each movable contact 65 bridges its associated stationary contact jaws 64, 66. Opposite snap action motion is imparted to contact carrier 75 when shaft section 79 is pivoted clockwise from the position of FIG. 17 to the position of FIG. 16. It is noted that even if spring 85 fails, operation of handle 40 will open and close switch unit 20.

In the switch open and switch closed positions the end of operating spring 85 remote from toggle knee 83 bears against opposite surfaces of V-shaped embossment 86 thereby stabilizing the movable elements of fused switch unit 20. Formations 87, 88 extending from one surface of contact carrier main section 76 and formations 91, 92 extending from the other surface of main section 76 stabilize contact carrier 75 in the switch open and switch closed positions.

Figure 5:
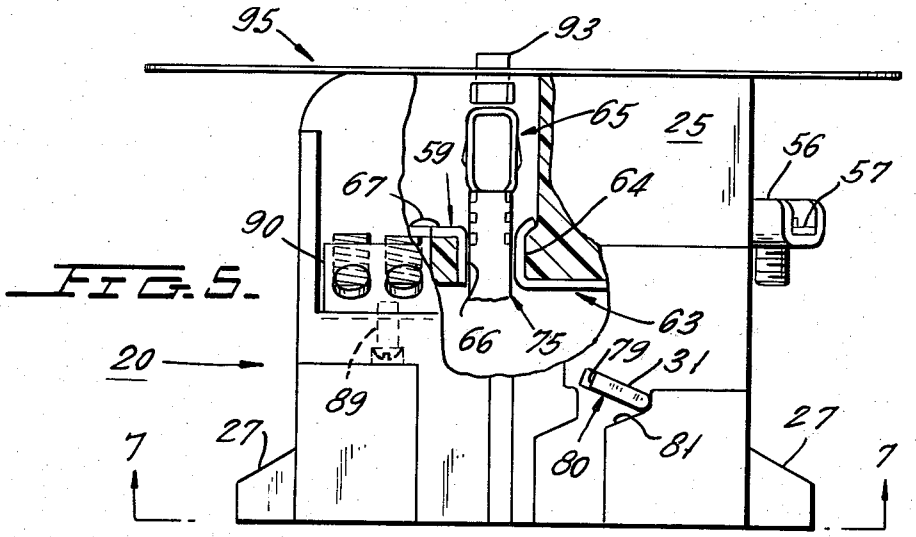

Screw 89 operatively secures neutral bar assembly 90 to base 25 on a ledge thereof open at the side opposite shaft extension 31. Base 25, at the side thereof adjacent to shaft extension 31, is provided with an aperture wherein spring hinge member 93 is secured. The latter pivotally mounts shield 95 constructed of transparent insulating sheet material. In its active position shown in FIGS. 1, 5 and 7, shield 95 is adjacent the front surface of base 25 with shield apertures 94, 94 being aligned with shells 61, 61 so that fuses may be inserted into receptacles 60, 60 when shield 95 is positioned in front of load and line terminals 57, 59. When shield 95 is pivoted forward to its inactive position to permit access to terminals 57, 59 shield 95 projects forward out of enclosure 21 thereby preventing the closing of cover 22.

It is noted that contact carrier 75 is so mounted that the front edge is visible through shield 95. This permits a visual observation of whether the switch contacts are open or closed.

Although the present invention has been described with respect to preferred embodiments, it should be understood that many variations and modifications will now be obvious to those skilled in the art, and it is preferred, therefore, that the scope of the invention be limited not by the specific disclosure herein, but only by the appended claims.

What is claimed is:

1. Electric switch apparatus, comprising:

an insulating base, said insulating base including a front and a back connected by opposite first and second sides and opposed first and second ends; confronting closely-spaced, generally parallel first and second stationary contact jaws, a U-shaped movable contact including, in cross-section, relatively long first and second arms connected at their first ends by a relatively short web and extending rearward from the latter, an insulating carrier to which said movable contact is mounted, said carrier being movable between circuit opened and circuit closed positions; in said circuit closed position said movable contact being disposed in the space between said jaws with said first and second arms in engagement with the respective first and second jaws; in said circuit opened position said movable contact disengaged from said jaws; said contact jaws having the surfaces thereof, opposite those surfaces engaged by the contact arms, disposed adjacent to surfaces of said base; a line terminal at said first end and a load terminal at said second end, circuit means connected between said terminals, said circuit means including said movable contact and said jaws, said base also including guide channels wherein said carrier is mounted for front to rear movement between said circuit opened and said circuit closed positions, respectively, and an over-center spring powered operating means on said base for moving said carrier in said channels, said operating means including an operating lever having a shaft section and a tongue extending transverse to said shaft section through an aperture in said carrier, said lever being seated in aligned bearing formations in said sides of said base.

2. Electric switch apparatus as set forth in claim 1 in which the operating lever is a thin flat member and the bearing formations are V-shaped.

3. Electric switch apparatus as set forth in claim 1 in which the operating means also includes a coiled compression spring having one of its ends bearing against the end of the tongue remote from the shaft section, and the other end of the spring bearing against an internal seating formation of said base.

4. Electric switch apparatus as set forth in claim 3 in which the spring and the tongue are disposed to constitute an overcenter toggle mechanism.

5. Electric switch apparatus as set forth in claim 1 in which the movable contact is disposed so that upon movement of said carrier to said circuit closed position the free ends of the arms are the first portions thereof to enter the space between said jaws and are the last portions of said arms to leave said space as said carrier moves to said circuit open position.

6. Electric switch apparatus as set forth in claim 5 in which said movable contact is floatably mounted to said carrier.

7. Electric switch apparatus as set forth in claim 1 also including confronting third and fourth closely spaced generally parallel jaws mounted to said base, another U-shaped movable contact mounted to the carrier for movement thereby into and out of engagement with said third and fourth jaws as the carrier moves to its said circuit closed and open positions, respectively.

8. Electric switch apparatus as set forth in claim 7 in which each of the U-shaped movable contacts comprises an individual spring member disposed within an individual aperture of the carrier.

9. Electric switch apparatus, comprising:

an insulating base;

first and second generally planar, parallel stationary contact jaws supported by said base and spaced apart by a first distance as measured in a direction perpendicular to said generally planar stationary contact jaws;

a U-shaped movable contact formed of a conductive resilient material and including a pair of relatively long generally planar and parallel contact arms extending therebetween, said contact arms and said web cooperating to define a spring member and said contact arms extending rearward from said web, each of said contact arms having an embossment forming an outwardly projecting contact surface extending therefrom in a direction perpendicular to said generally planar contact arm and away from the remaining contact arm, the outermost surfaces of said outwardly projecting contact surfaces being spaced apart by a second distance as measured in a direction perpendicular to said generally parallel contact arms when said contact arms are not forced inwardly by an external force, said second distance being greater than said first distance; and an insulating carrier supporting said movable contact for movement between a forward open circuit position, wherein said contact arms are out of contact with said stationary contact jaws and are not forced inwardly by an external force, and a rearward closed circuit position, wherein said contact arms are located in the space between said contact jaws with said projecting contact surfaces in contact with said contact jaws and said contact jaws force said contact arms toward each other such that the resilient nature of said movable contact material forces said projecting contact surfaces outward into pressure contact with said contact jaws;

said contact jaws having the surfaces thereof, opposite those surfaces engaged by the contact arms, disposed adjacent to surfaces of said base;

said movable contact when in said open circuit position being disposed entirely outside of the space between said contact jaws and being visible from a position in front of said base.

10. Electric switch apparatus as set forth in claim 9 in which each of said contact arms is substantially wider than the embossment thereof which forms said contact surfaces.

11. Electric switch apparatus as set forth in claim 9 in which each of said embossments is tapered forward and rearward of the respective contact surface defined thereby, with the forward taper being substantially more gradual than the rearward taper.

12. Electric switch apparatus as set forth in claim 9 wherein said movable contact is disposed within an aperture of said carrier, said aperture of said carrier having a length and width, measured in a plane parallel to the plane of movement for said carrier, corresponding approximately to the length and width of said contact arms.

13. Electric switch apparatus as set forth in claim 12 wherein said base includes guide channels in which said carrier is mounted for movement between said open and closed circuit positions, said movable contact extending partially into a first of said channels for retention in said aperture.

14. Electric switch apparatus as set forth in claim 9 also including an enclosure having an openable front cover and a rear wall, said base being disposed within said enclosure and secured to said rear wall, a transparent insulating shield mounted at the front of said base and operable between an active position, disposed in front of said terminals and said carrier and through which said carrier is viewable to ascertain whether said movable contact is in said open or said closed circuit position, and an inactive position permitting access to said terminals.

15. Electric switch apparatus as set forth in claim 14 wherein said shield blocks access to said terminals when in said active position and interferes with closing of said cover when in said inactive position.

* * * * *